US009701521B2

(12) United States Patent
Wimmer

(10) Patent No.: US 9,701,521 B2
(45) Date of Patent: Jul. 11, 2017

(54) CRANE, IN PARTICULAR LOADING CRANE FOR A VEHICLE

(71) Applicant: Palfinger AG, Salzburg (AT)

(72) Inventor: Eckhard Wimmer, Hallein (AT)

(73) Assignee: PALFINGER AG, Salzburg (AT)

( * ) Notice: Subject to any disclaimer, the term of this patent is extended or adjusted under 35 U.S.C. 154(b) by 422 days.

(21) Appl. No.: 14/268,287

(22) Filed: May 2, 2014

(65) Prior Publication Data

US 2014/0263145 A1 Sep. 18, 2014

Related U.S. Application Data

(63) Continuation of application No. PCT/AT2012/000238, filed on Sep. 14, 2012.

(30) Foreign Application Priority Data

Nov. 8, 2011 (AT) ..... GM607/2011

(51) Int. Cl.
*B66C 23/68* (2006.01)
*B66C 23/687* (2006.01)
(Continued)

(52) U.S. Cl.
CPC ..... *B66C 23/42* (2013.01); *B66C 23/54* (2013.01); *B66C 23/68* (2013.01); *B66C 23/705* (2013.01); *B66C 23/707* (2013.01)

(58) Field of Classification Search
CPC ..... B66C 23/42; B66C 23/54; B66C 23/68; B66C 23/705; B66C 23/707; B66C 23/00;
(Continued)

(56) References Cited

U.S. PATENT DOCUMENTS 3,837,502 A 9/1974 Hornagold
4,605,132 A * 8/1986 van Seumeren ..... B63B 27/10 212/230
(Continued)

FOREIGN PATENT DOCUMENTS

CN 201525712 7/2010
CN 101880010 11/2010
(Continued)

OTHER PUBLICATIONS

Chinese Office Action w/text portion thereof (OA) and Search Report (SR) issued Mar. 2, 2015 in counterpart Chinese Application No. 201280062785.4.
(Continued)

*Primary Examiner* — Sang Kim
*Assistant Examiner* — Juan Campos, Jr.
(74) *Attorney, Agent, or Firm* — Wenderoth, Lind & Ponack, L.L.P.

(57) ABSTRACT

A crane includes a crane pillar rotatably mounted about a vertical axis, at least one jib, connected to the crane pillar and pivotally mounted about a horizontal axis, at least one jib extension movably mounted in the jib, and at least one piston-cylinder unit for extending and retracting the jib extension relative to the jib. The first end of the piston-cylinder unit engages the jib via at least one first force-introducing region, and the second end engages the at least one jib extension via at least one second force-introducing region. The piston-cylinder unit has a central plane parallel to the horizontal axis about which the jib is pivotally mounted, and the piston-cylinder unit has a compressive deformation perpendicular to the central plane in a pressure-loaded state while the jib is being extended and a tensile deformation opposite the compressive deformation in a tension-loaded state while the jib is being retracted.

13 Claims, 9 Drawing Sheets

(51) Int. Cl.

| | |
|---|---|
| ***B66C 23/70*** | (2006.01) |
| ***B66C 23/42*** | (2006.01) |
| ***B66C 23/00*** | (2006.01) |

(58) Field of Classification Search

CPC ..... B66C 23/04; B66C 23/342; B66C 23/62; B66C 23/64; B66C 23/66; B66C 23/701; B66C 25/00

USPC ..... 212/276

See application file for complete search history.

(56) References Cited

U.S. PATENT DOCUMENTS

| | | | |
|---|---|---|---|
| 4,733,598 | A | 3/1988 | Innes et al. |
| 5,632,395 | A | 5/1997 | Zimmermann |
| 2005/0218101 | A1 | 10/2005 | Montineri |
| 2010/0282700 | A1 | 11/2010 | Richter |

FOREIGN PATENT DOCUMENTS

| | | |
|---|---|---|
| CN | 101927966 | 12/2010 |
| DE | 36 20 663 | 1/1987 |
| EP | 0 476 225 | 3/1992 |
| EP | 0 669 279 | 8/1995 |
| JP | 55-117480 | 8/1980 |
| JP | 58-56787 | 4/1983 |
| JP | 58-172192 | 10/1983 |
| JP | 64-39390 | 3/1989 |
| JP | 4-14286 | 2/1992 |
| JP | 2001-341981 | 12/2001 |
| RU | 2167803 | 5/2001 |
| RU | 2264347 | 11/2005 |

OTHER PUBLICATIONS

International Search Report (ISR) issued Nov. 19, 2012 in International (PCT) Application No. PCT/AT2012/000238.

Austrian Patent Office Search Report (ASR) issued Jun. 18, 2012 in Austrian Patent Application No. GM 607/2011.

* cited by examiner

State of the art

State of the art

State of the art

CRANE, IN PARTICULAR LOADING CRANE FOR A VEHICLE

The invention concerns a crane, in particular a loading crane for a vehicle, comprising a crane pillar mounted rotatably about a vertical axis, at least one jib connected to the crane pillar and mounted pivotably about a horizontal axis and at least one jib extension mounted displaceably in the jib, and at least one piston-cylinder unit for extending and retracting the jib extension relative to the jib, wherein the at least one piston-cylinder unit with its first end engages the jib by way of at least one first force-application region and with its second end engages the at least one jib extension by way of at least one second force-application region, wherein the at least one piston-cylinder unit has a central plane which extends in a viewing direction parallel to the horizontal axis about which the jib is pivotably mounted, and wherein the at least one piston-cylinder unit in a compressive-loaded condition upon extension has a compressive deformation in a direction perpendicularly to the central plane and in a tensile-loaded condition upon retraction has a tensile deformation in a direction opposite to the compressive deformation.

FIG. 1 diagrammatically shows an overall perspective view of an example of a crane of the general kind set forth, which is relevant in connection with the present invention. More precisely this involves a loading crane 1 which can be mounted on a vehicle. It includes inter alia a crane pillar 3 which is mounted rotatably about a vertical axis V (on a crane base 16), a jib 4 which is connected to the crane pillar 3 and which is mounted pivotably about a horizontal axis H, and a jib extension 5 mounted displaceably in the jib 4. In connection with the illustrated example of a loading crane, reference is also made in relation to the jib 4 to the second jib while in regard to the jib extension 5 reference is also made to the thrust extension. The illustrated loading crane 1 further includes a piston-cylinder unit 6 for extending and retracting the jib extension 5 relative to the jib 4, wherein the piston-cylinder unit 6 with its first end engages the jib 4 by way of a first force-application region while with its second end it engages the jib extension 5 by way of a second force-application region, and wherein the piston-cylinder unit 6 has a central plane M extending in a viewing direction parallel to the horizontal axis H about which the jib 4 is mounted pivotably, the central plane M being indicated by a broken line for example in FIG. 2*a* concerning the state of the art. In connection with the illustrated example of a loading crane, in regard to the cylinder 18 of the piston-cylinder unit 6, reference is frequently also made to a thrust extension cylinder. Arranged between the second jib 4 and the crane pillar 3 is a first jib 2. The piston-cylinder units 9 and 10 serve to move the first and second jibs. For the sake of completeness it should also be mentioned that the loading crane 1 shown in FIG. 1 serves to lift a load which can be suspended on the hook 17 on to or off the load surface of a vehicle. The loading crane 1 is controlled by way of a control and regulating unit 15. The loading crane 1 is supported by way of laterally extendable support devices including the components 11 through 14.

FIGS. 2*a* and 2*b* show by means of an example how in accordance with the state of the art the transmission of force is effected when extending and retracting the jib extension 5 relative to the jib 4, between the piston-cylinder unit 6 and the jib extension 5, wherein FIG. 2*a* is a diagrammatic side view and FIG. 2*b* is a diagrammatic cross-sectional view of a portion of the loading crane, being relevant for comprehension purposes, from the region of the rod head 20 of the piston rod 19 of the piston-cylinder unit 6. In the illustrated example of the state of the art the transmission of force is implemented in that a bolt 23 is anchored in the rod head 20 in centered relationship with the central plane M of the piston-cylinder unit 6, wherein the two ends of the bolt 23 project at both sides from the rod head 20 (see FIG. 2*b*) and in that way afford two regions 8 for the transmission of force. The two ends of the bolt 23 are mounted in vertical slots disposed in two pivot mounting bars 22, wherein the pivot mounting bars 22 are connected to the jib extension 5 by way of a fixing device 21.

It is generally known that the piston-cylinder unit is exposed to deformations, in particular in the extended condition and under maximum loading. The configuration of flexural moments or stresses in the piston rod is diagrammatically shown in FIG. 3*a* for the above-described example in the state of the art, in which the transmission of force between the piston-cylinder unit and the jib extension is effected by way of force-application regions arranged centrally relative to the central plane of the piston-cylinder unit. In that respect sub-FIG. (1) shows the flexural moment or stress configuration resulting from the (pure) ambient deformation f. Sub-FIG. (2) shows the flexural moment or stress configuration resulting from an extension force $F_A$ and sub-FIG. (3) finally shows the overall configuration resulting from superimpositioning of the components shown in sub-FIGS. (1) and (2). Upon retraction of the jib extension the flexural moment or stress configuration in sub-FIG. (2) would be mirrored upwardly.

A disadvantage with the transmission of force between the piston-cylinder unit and the jib extension in accordance with the state of the art is that, if there is a wish to provide dimensions for the loading crane for a greater load, that is possible (with the structural principle remaining the same) only by way of a strengthening of the piston-cylinder unit, in particular an increase in the material thickness, in order to keep the deformations of the piston-cylinder unit, that are described by way of example with reference to FIG. 3*a*, within limits. As a further consequence that involves higher costs and a greater weight.

Therefore the object of the present invention is to avoid the above-described disadvantages and to provide a structure which is improved over the state of the art for the crane of the general kind set forth as described in the opening part of this specification.

According to the invention that object is attained in that the at least one piston-cylinder unit with its second end engages the at least one jib extension by way of at least two force-application regions and one of said at least two force-application regions is arranged in displaced relationship with the central plane in the direction opposite to the compressive deformation and the other of said at least two force-application regions is arranged in displaced relationship with the central plane in the direction opposite to the tensile deformation.

BRIEF DESCRIPTION OF THE DRAWINGS

Details and advantageous embodiments of the invention which are recited in the appendant claims are described in greater detail in the specific description hereinafter by means of the Figures which have not yet been described in the introductory part of the description. In the drawings:

As already stated hereinbefore the basic idea of the invention is that at least some of the force-application regions, by way of which the at least one piston-cylinder unit with its second end engages the at least one jib extension, are arranged in displaced relationship with the central plane of the piston-cylinder unit. By virtue of such eccentric application of forces in relation to the central plane of the piston-cylinder unit the force for extension and retraction of the jib extension in the deformed condition can be increased markedly in comparison with a central application of forces in relation to the central plane without the piston-cylinder unit having to be reinforced for that purpose.

Figure 1:
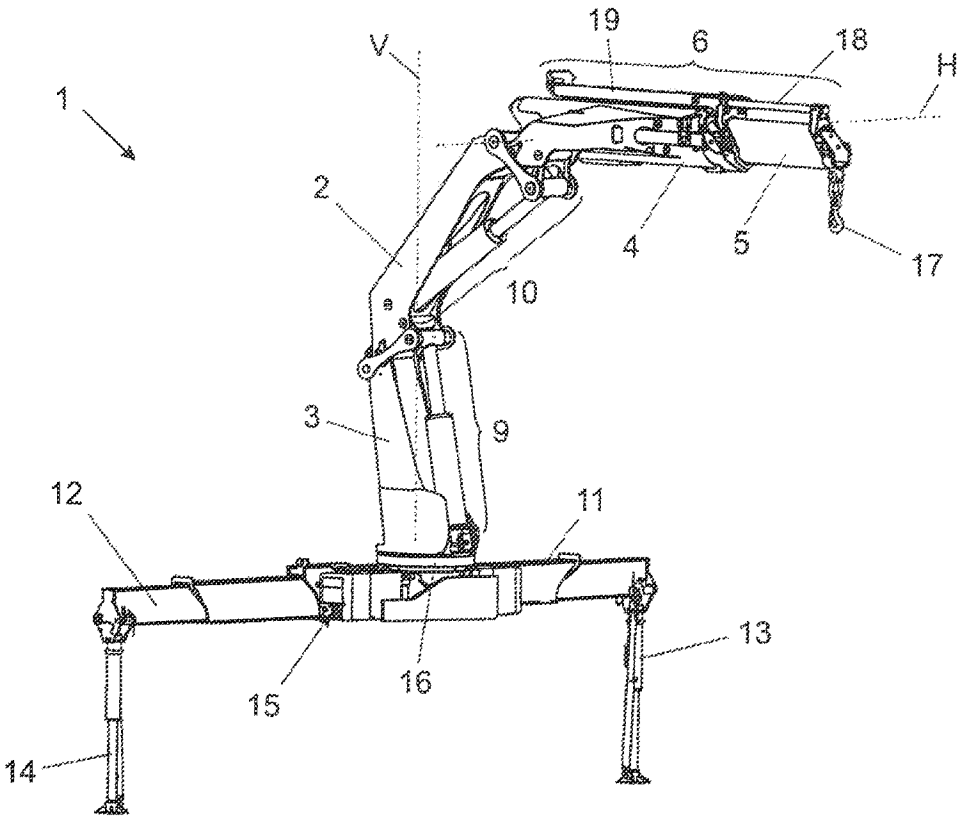
FIG. 1 is a diagrammatic perspective view of a conventional crane.
Figure 2B:
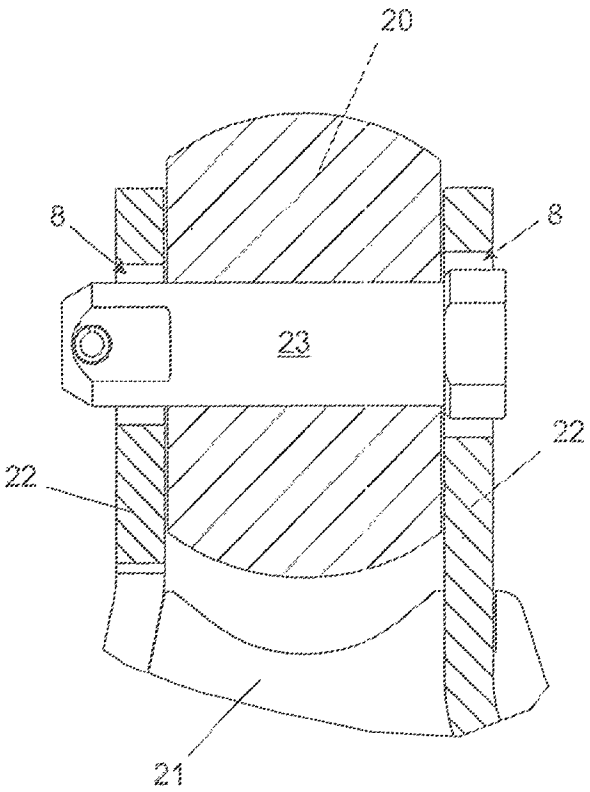
FIGS. 2*a* and 2*b* illustrate how conventional transmission force is effected when extending or retracting a jib extension relative to a jib.
Figure 2A:
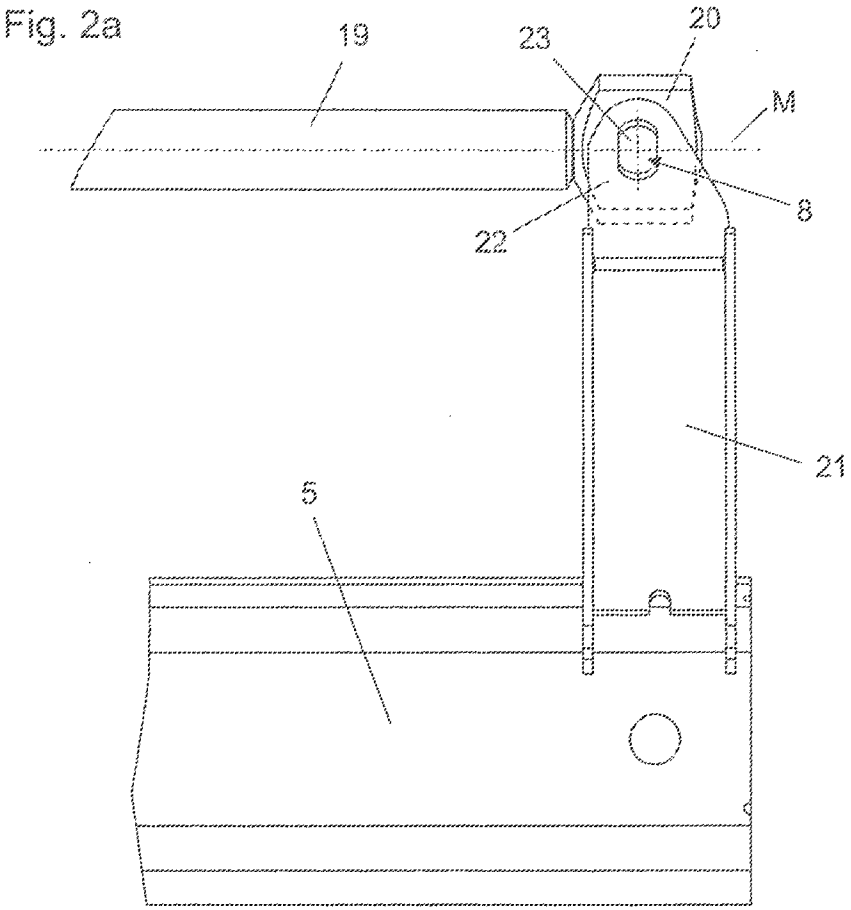
Figure 3A:
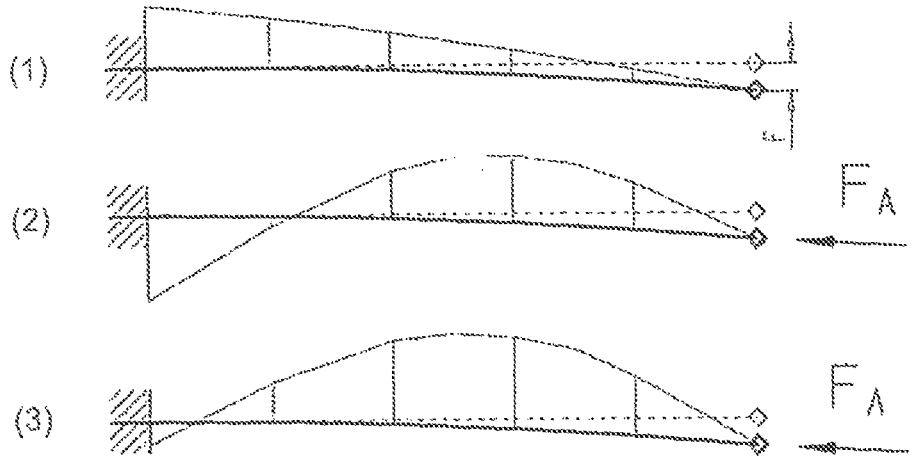
FIG. 3*a* is a diagram illustrating flexural movements or stresses in state-of-the-art piston rods.
Figure 3B:
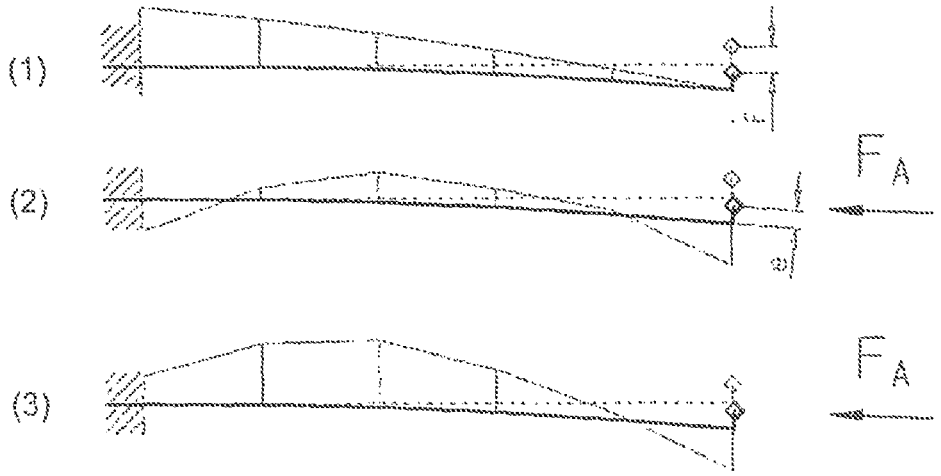
FIGS. 3*b* diagrammatically shows the flexural moment or stress configuration in a piston rod in the case of a force-application region arranged in displaced relationship with the central plane.

That effect can be seen from FIG. 3*b*: this Figure diagrammatically shows, like also above-described FIGS. 3*a*, the flexural moment or stress configuration in the piston rod, wherein sub-FIG. (1) of FIG. 3*b* again shows the flexural moment or stress configuration resulting from the (pure) ambient deformation f, sub-FIG. (2) shows the flexural moment or stress configuration resulting from an eccentrically applied extension force $F_A$, wherein reference e denotes the eccentricity of the application of force, and sub-FIG. (3) shows the overall configuration resulting from superimpositioning of the components shown in sub-FIGS. (1) and (2). If now the two sub-FIGS. (3) of FIGS. 3*a* and 3*b* are compared it is directly apparent that the maximum amplitude in the case of FIG. 3*b* is markedly reduced in comparison with FIG. 3*a*. That means that the load moved by means of the piston-cylinder unit or the jib and the jib extension, with the deformation of the piston-cylinder unit remaining the same, can be markedly increased.

Figure 4A:
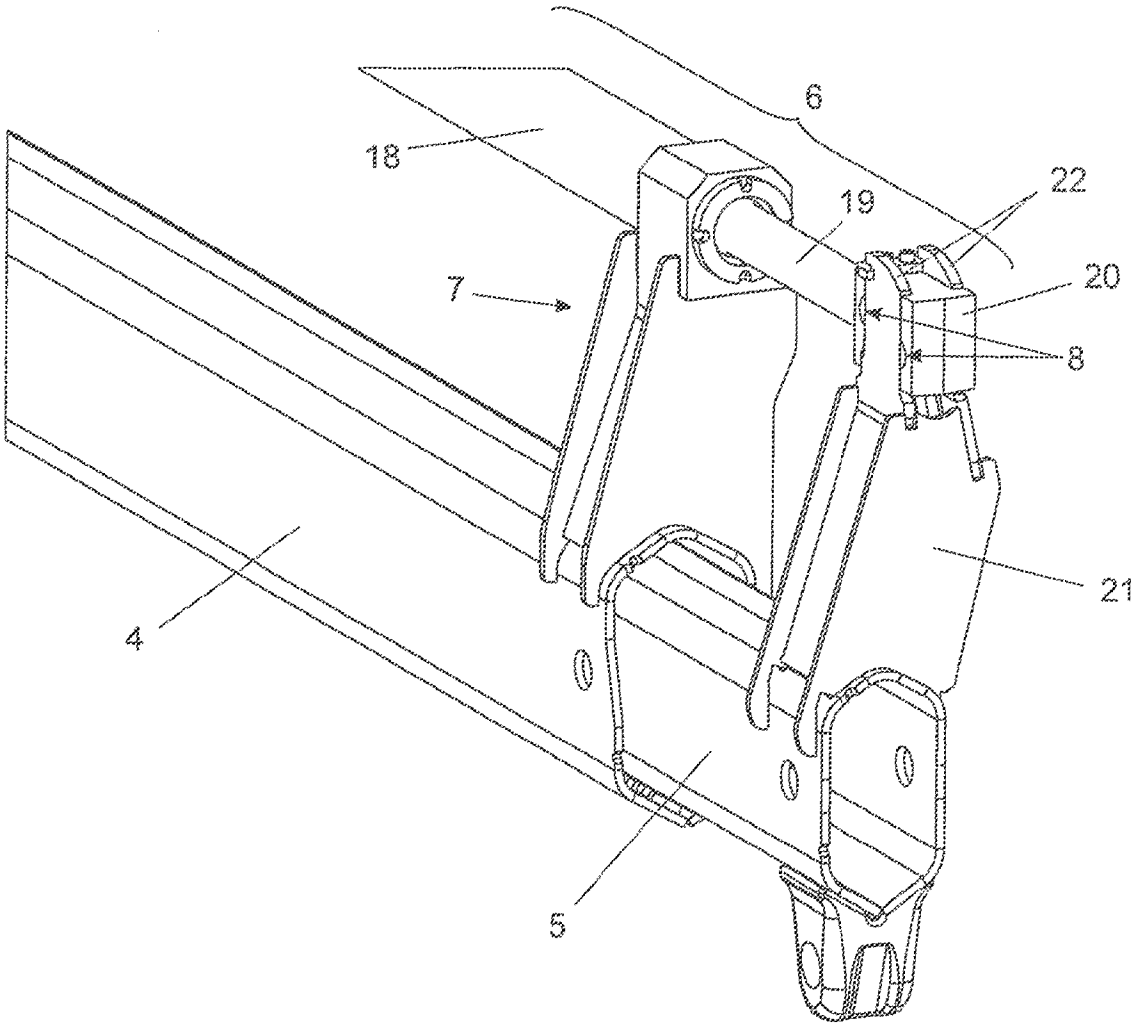
FIGS. 4*a* and 4*b* show a diagrammatic perspective view (FIG. 4*a*) and a diagrammatic side view (FIG. 4*b*) of a portion of a crane, that is relevant for understanding a first embodiment of the invention.
Figure 4C:
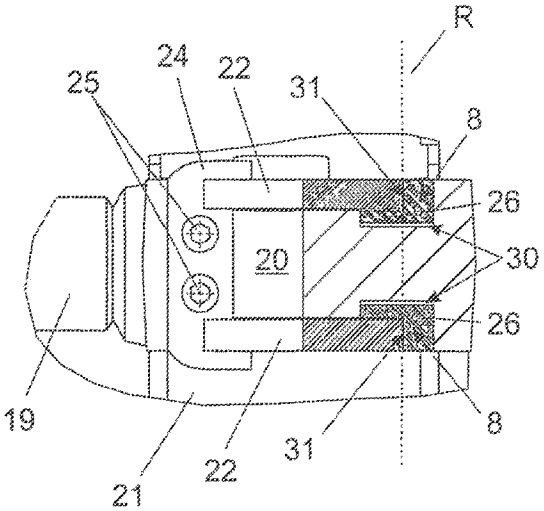
FIG. 4*c* shows a diagrammatic view from above on to two partial regions of the rod head in the first embodiment.
Figure 4B:
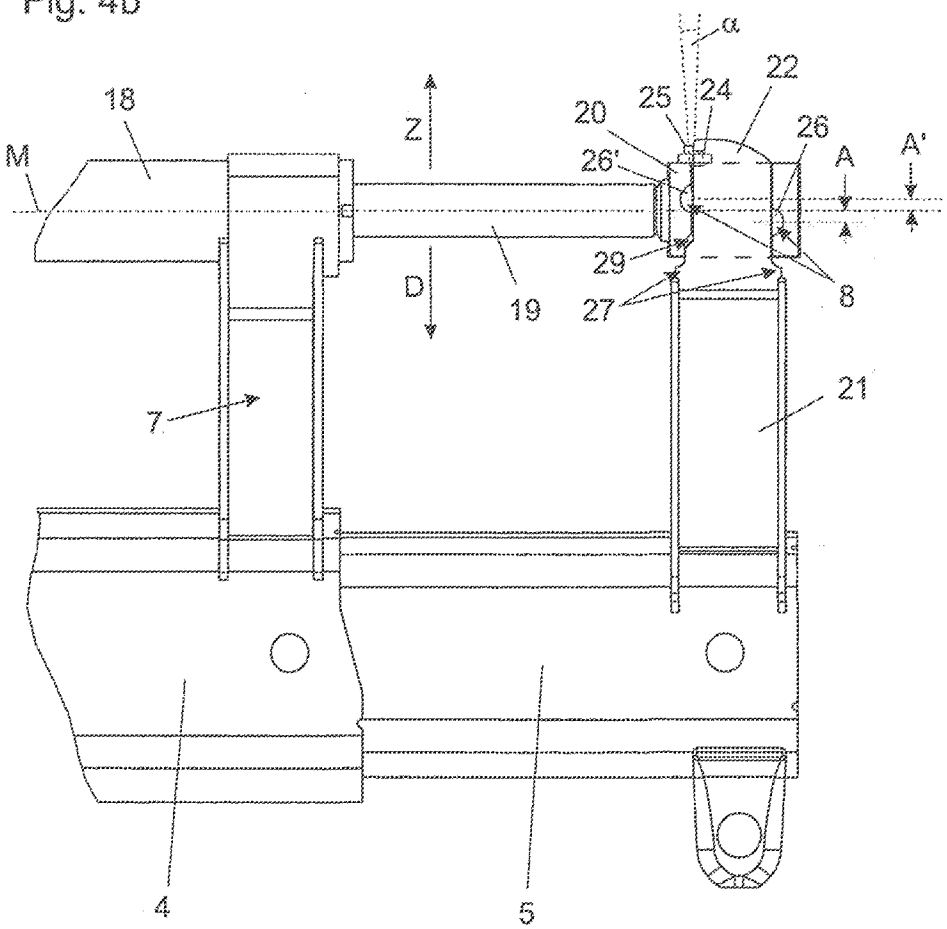

FIGS. 4*a*, 4*b* and 4*c* show a first embodiment of the invention, wherein only the region of a loading crane, that is relevant to understanding the invention, is to be seen here in each case. In this first embodiment the piston-cylinder unit 6 with its first end, in this case being the end which includes the cylinder 18, engages the jib 4 by way of a first force-application region 7, while with its second end which in this case is the rod head 20 of the piston rod 19 it engages the jib extension 5 by way of four further force-application regions 8. Those four force-application regions 8 of which only two are visible in each of the Figures by virtue of the views adopted are in this embodiment respectively embodied by substantially cylindrical insert segments 26 and 26', wherein those insert segments 26 and 26' are mounted in positively locking relationship in a respective bore 30 in the rod head 20 of the piston rod 19 of the piston-cylinder unit 6, more specifically in such a way that they are mounted in the bores 30 rotatably about an axis of rotation R extending parallel to the horizontal axis H about which the jib 4 is mounted pivotably. The insert segments 26 and 26' each have on one side a respective straight surface 31, by way of which they bear against the pivot mounting bars 22, wherein those two pivot mounting bars 22 are connected to the jib extension 5 by way of a fixing device 21. The two pivot mounting bars 22 are mounted in positively locking relationship with play in two openings 29 arranged at both sides symmetrically on the rod head 20. This means that the openings 29 are somewhat larger than the pivot mounting bars 22. By virtue of that positively locking relationship with play and the fact that the insert segments 26 and 26' which are connected to the pivot mounting bars 22 are mounted rotatably, overall the pivot mounting bars 22 are rotatable in the openings 29 in a limited angular range a about an axis of rotation extending parallel to the horizontal axis H about which the jib 4 is mounted pivotably. In the event of an excessively great angular deviation between the piston rod 19 and the jib extension 5 or the pivot mounting bars 22 the positively locking relationship becomes operative and the connection is so-to-speak 'clamped' and in that way 'buckling' of the piston rod 19 is avoided. The pivot mounting bars 22 are prevented from moving away upwardly (as seen in FIG. 4*b*) or downwardly by a lock member 24 fixed to the rod head 20 by means of two screws 25 on the one hand and a specific configuration in the regions 27 of the pivot mounting bars 22 on the other hand. As regards the precise arrangement of the four force-application regions 8 in this embodiment, it is to be emphasised that two of those four force-application regions 8 are arranged on the side of the rod head 20 that is visible in FIG. 4*b* and the other two force-application regions 8 are arranged symmetrically on the opposite side of the rod head 20. In addition, a respective one of the two force-application regions 8 present on the two sides is arranged in displaced relationship with the central plane M of the piston-cylinder 6 above same while the other of the two force-application regions 8 is arranged in displaced relationship with the central plane M below same. In other words therefore one of the two force-application regions 8 is arranged in displaced relationship with the central plane M in the direction opposite to the compressive deformation D and the other of the two force-application regions 8 is arranged in displaced relationship with the central plane M in the direction opposite to the tensile deformation Z, wherein the compressive deformation D in a compressive-loaded condition occurs upon extension of the jib extension 5 (see also FIG. 3*b*) and the tensile deformation in a tensile-loaded condition occurs upon retraction of the jib extension 5. This means that the force-application region 26' arranged in displaced relationship with the central plane M above it at a spacing A' deploys a load-relief action in the compressive-loaded condition and the force-application region 26 arranged in displaced relationship with the central plane M below same at a spacing A deploys a load-relief action in the tensile-loaded condition.

It should also be noted that FIG. 4*c* involves a divided view of the rod head 20 from above, wherein the left-hand part of the view shows the lock member 24 which prevents the pivot mounting bars 22 from moving upwardly—that is to say towards the viewer—while the right-hand part of the view shows a cross-section in the region of the insert segments 26.

Figure 5A:
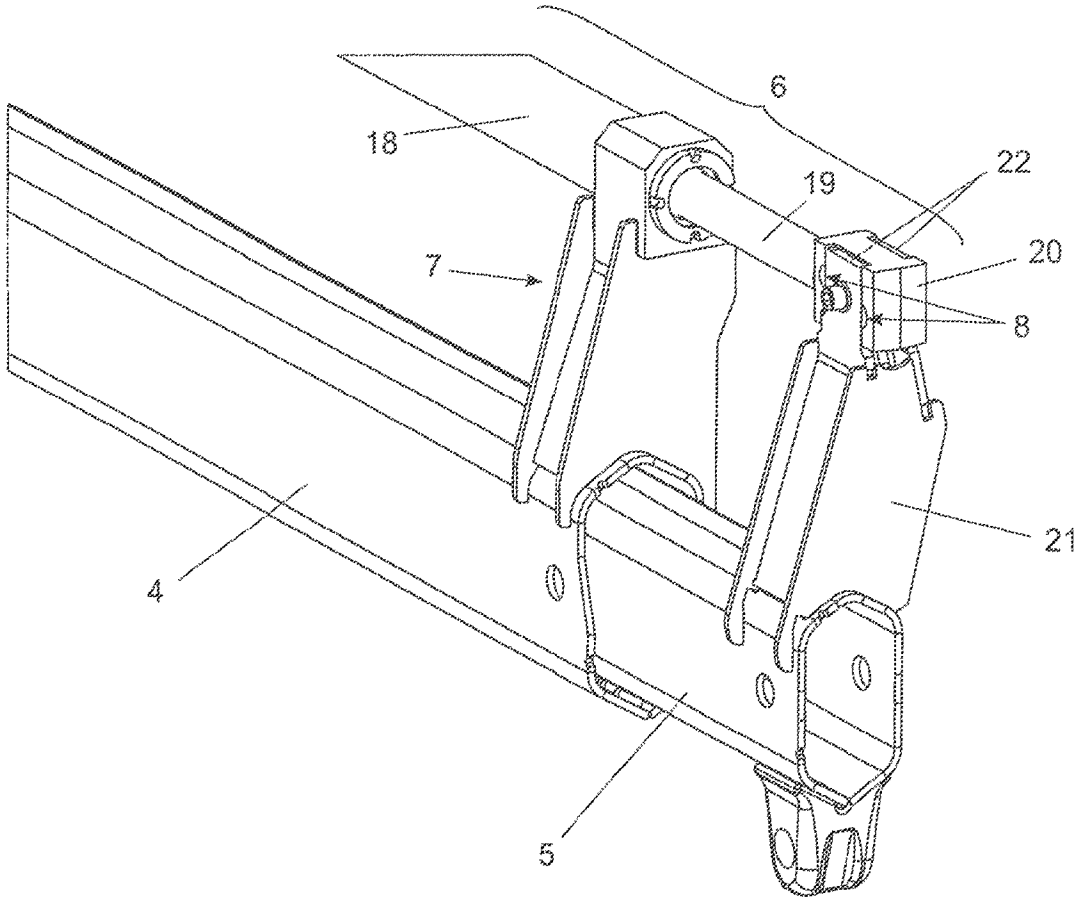
FIGS. 5*a* and 5*b* show a diagrammatic perspective view (FIG. 5*a*) and a diagrammatic side view (FIG. 5*b*) of a portion of a crane, that is relevant for understanding a second embodiment of the invention.
Figure 5C:
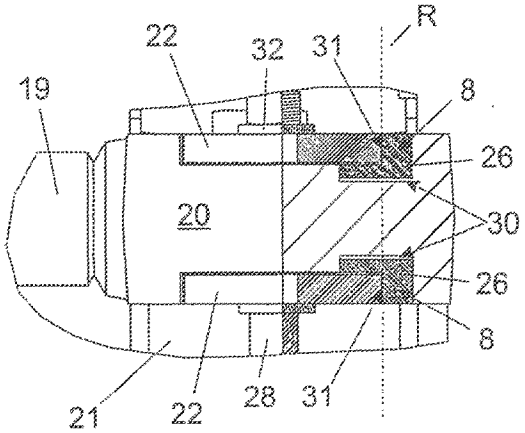
FIG. 5*c* shows a diagrammatic view from above on to two partial regions of the rod head in the second embodiment.
Figure 5D:
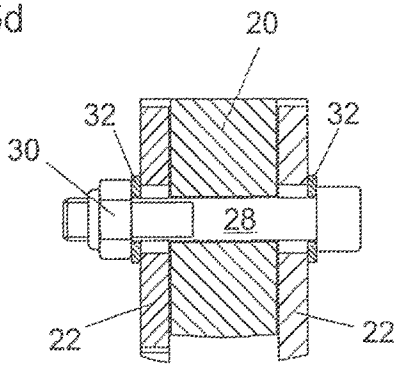
FIG. 5*d* shows a diagrammatic cross-section of the rod head in the second embodiment.
Figure 5B:
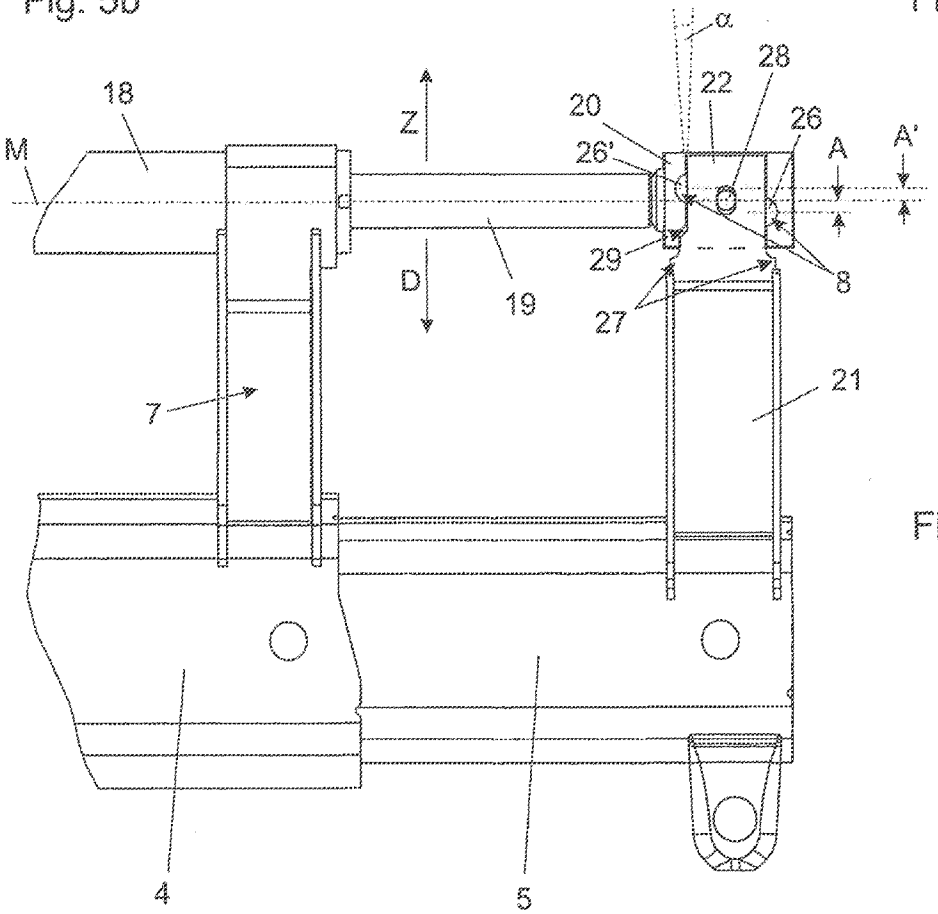

FIGS. 5*a*, 5*b*, 5*c* and 5*d* show a second preferred embodiment of the invention, the same views being adopted in FIGS. 5*a*, 5*b* and 5*c* as in FIGS. 4*a*, 4*b* and 4*c*. The transmission of force between the rod head 20 of the piston rod 19 of the piston-cylinder unit 6 to the jib extension 5 is implemented by way of the force-application regions 8 in the same way as in the first embodiment described above. Only the kind of fixing of the pivot mounting bars 22 to the piston rod head 20 is different in this embodiment. As already stated the pivot mounting bars 22 are prevented from moving upwardly in the first embodiment by the lock member screwed to the rod head 20. In the second embodiment, in comparison therewith, that effect is achieved by means of the pivot mounting bars 22 being screwed to the rod head 20. That screw means can be seen in particular in FIG. 5*d*: reference 28 denotes a screw, reference 32 denotes two washers and reference 30 denotes a nut having a female thread corresponding to the screw 28.

Figure 6A:
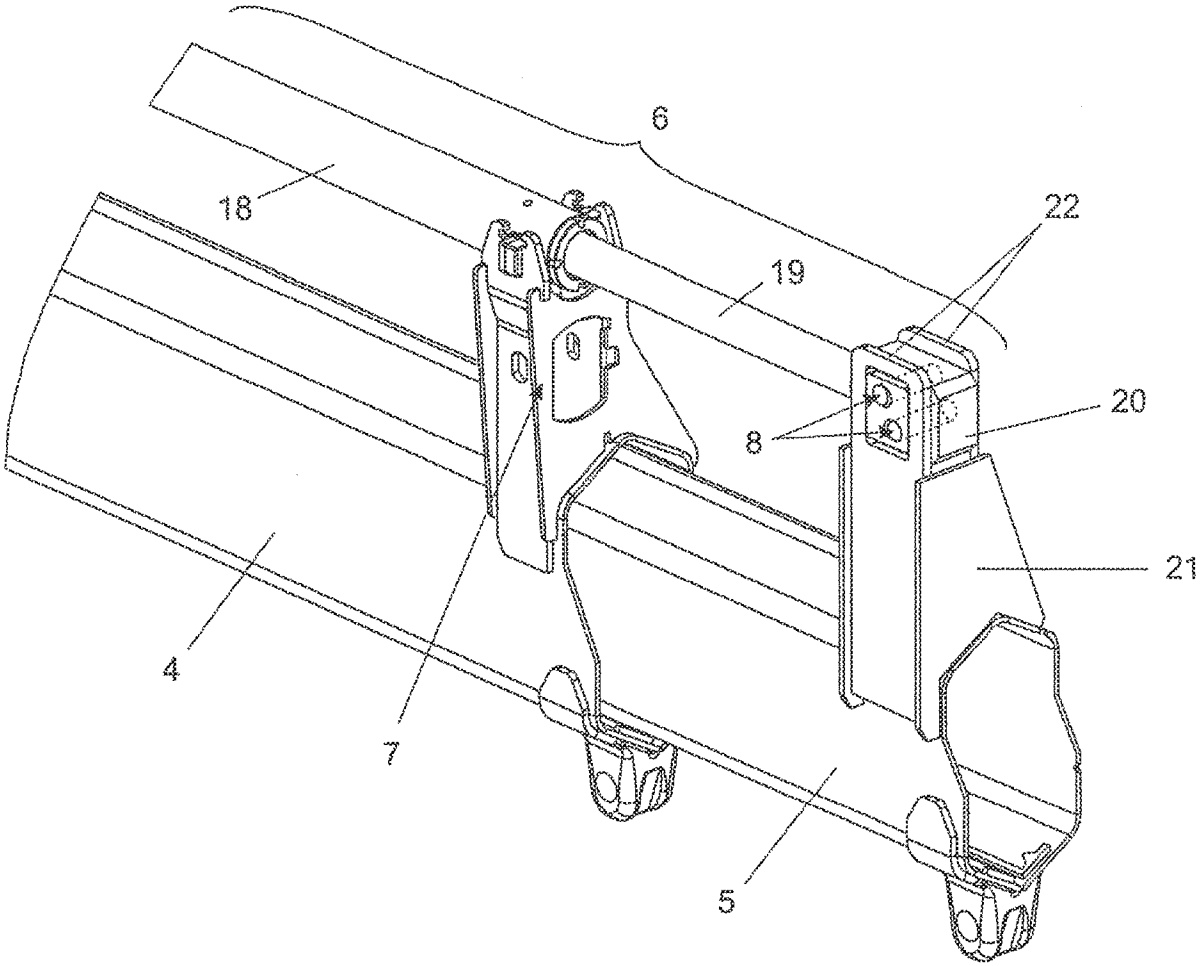
FIGS. 6*a* and 6*b* show a diagrammatic perspective view (FIG. 6*a*) and a diagrammatic side view (FIG. 6*b*) of portions of a crane, that are relevant for understanding a third embodiment of the invention.
Figure 6B:
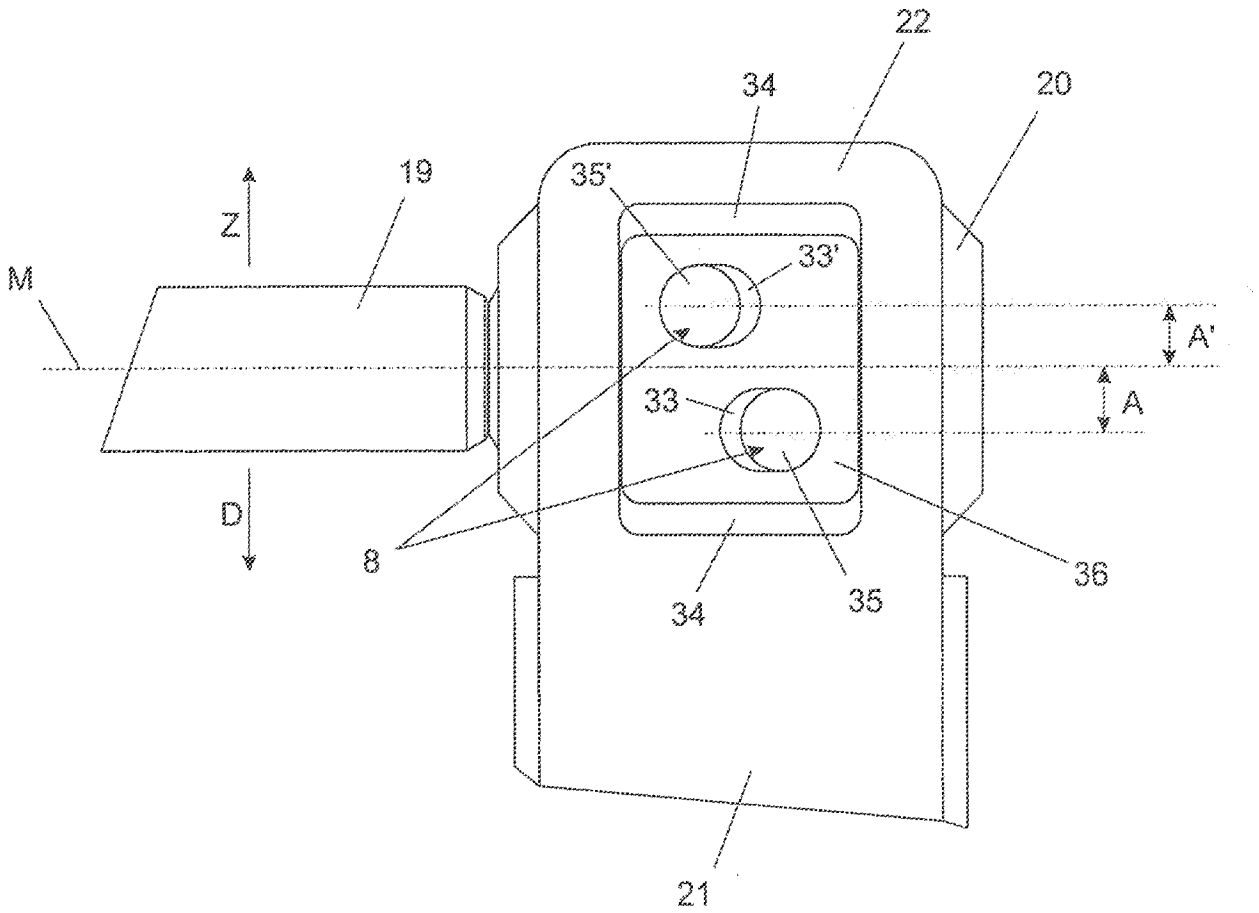

FIGS. 6*a* and 6*b* show a third preferred embodiment of the invention, wherein a respective portion of a crane that is relevant to understanding of this embodiment is to be seen therein. In that respect FIG. 6*a* is a diagrammatic perspective view and FIG. 6*b* is a diagrammatic side view. In this third embodiment the force-application regions 8, by way of which the piston-cylinder unit 6 engages the jib extension 5, are embodied by two cylindrical bolt devices 35 and 35' mounted in positively locking relationship in bores in the rod head 20 of the piston-cylinder unit 6. The ends of the bolt devices 35 and 35' project at both sides out of the rod head 20 and are mounted in slots 33 and 33' of two intermediate devices 36 in the form of substantially rectangular plates. The two intermediate devices 36 arranged at both sides on the rod head 20 are in turn mounted in openings 34 in two pivot mounting bars 22, wherein the openings 34 (to be seen in FIG. 6*b*) are enlarged upwardly and downwardly in such a way that the intermediate devices 36 are displaceable in respect of height relative to the pivot mounting bars. The two pivot mounting bars 22 are again (as also in the other two embodiments) connected to the jib extension 5 by way of a fixing device 21. In this third embodiment the bolt device 33 is arranged in displaced relationship with the central plane M below same at a spacing A and deploys a load-relief action in the tensile-loaded condition. The second bolt device 33' is arranged in displaced relationship with the central plane M above same at a spacing A' and deploys a load-relief action in the compressive-loaded condition.

The invention claimed is:

1. A crane comprising a crane pillar mounted rotatably about a vertical axis, at least one jib connected to the crane pillar and mounted pivotably about a horizontal axis and at least one jib extension mounted displaceably in the jib, and at least one piston-cylinder unit for extending and retracting the jib extension relative to the jib, wherein the at least one piston-cylinder unit with a first end engages the jib by way of at least one first force-application region, and with a second end engages the at least one jib extension by way of at least two second force-application regions, wherein the at least one piston-cylinder unit has a central plane which extends in a viewing direction parallel to the horizontal axis about which the jib is pivotably mounted, and wherein the at least one piston-cylinder unit in a compressive-loaded condition upon extension has a compressive deformation in a direction perpendicularly to the central plane and in a tensile-loaded condition upon retraction has a tensile deformation in a direction opposite to the compressive deformation, and wherein one of said at least two second force-application regions is arranged in displaced relationship with the central plane of the at least one piston-cylinder unit in the direction opposite to the compressive deformation, and the other of said at least two second force-application regions is arranged in displaced relationship with the central plane in the direction opposite to the tensile deformation.

2. A crane as set forth in claim 1 wherein the second end of the at least one piston-cylinder unit engages the at least one jib extension by way of at least four second force-application regions, wherein two of the at least four second force-application regions are arranged in displaced relationship with the central plane in the direction opposite to the compressive deformation, and two of the at least four second force-application regions are arranged in displaced relationship with the central plane in the direction opposite to the tensile deformation.

3. A crane as set forth in claim 2, wherein the at least four second force-application regions are arranged preferably symmetrically on both sides of the at least one piston-cylinder unit.

4. A crane as set forth in claim 1, wherein at least one of the two second force-application regions, by way of which the second end of the at least one piston-cylinder unit engages the at least one jib extension, comprises at least one insert segment.

5. A crane as set forth in claim 4, wherein the at least one insert segment is mounted at least region-wise in positively locking relationship in a bore of the at least one piston-cylinder unit.

6. A crane as set forth in claim 5, wherein the at least one insert segment is mounted in the bore rotatably about an axis of rotation extending parallel to the horizontal axis about which the jib is pivotably mounted.

7. A crane as set forth in claim 4, wherein the at least one insert segment has at least one straight surface.

8. A crane as set forth in claim 7, wherein the at least one insert segment bears with the at least one straight surface against at least one pivot mounting bar, wherein the at least one pivot mounting bar is connected to the at least one jib extension by way of a fixing device.

9. A crane as set forth in claim 8, wherein the at least one pivot mounting bar is mounted in an opening of the at least one piston-cylinder unit.

10. A crane as set forth in claim 8, wherein the at least one pivot mounting bar is mounted in positively locking relationship with play in an opening of the at least one piston-cylinder unit.

11. A crane as set forth in claim 1, wherein at least one of the force-application regions, by way of which the second end of the at least one piston-cylinder unit engages the at least one jib extension, is embodied by at least one bolt device.

12. A crane as set forth in claim 11, wherein the at least one bolt device is mounted at least region-wise in positively locking relationship in a bore of the at least one piston-cylinder unit.

13. A crane as set forth in claim 11, wherein the at least one bolt device is connected by way of an intermediate device to at least one pivot mounting bar, wherein the at least one pivot mounting bar is connected to the at least one jib extension by way of a fixing device.

* * * * *